US010006636B2

(12) United States Patent
Ginessin et al.

(10) Patent No.: US 10,006,636 B2
(45) Date of Patent: Jun. 26, 2018

(54) ANTI-COKING LIQUID FUEL INJECTOR ASSEMBLY FOR A COMBUSTOR

(71) Applicant: General Electric Company, Schenectady, NY (US)

(72) Inventors: Leonid Yulievich Ginessin, Moscow (RU); Borys Borysovich Shershnyov, Moscow (RU)

(73) Assignee: General Electric Company, Schenectady, NY (US)

( * ) Notice: Subject to any disclaimer, the term of this patent is extended or adjusted under 35 U.S.C. 154(b) by 529 days.

(21) Appl. No.: 14/082,677

(22) Filed: Nov. 18, 2013

(65) Prior Publication Data

US 2015/0135716 A1 May 21, 2015

US 2017/0261209 A9 Sep. 14, 2017

(51) Int. Cl.
*F23R 3/28* (2006.01)
*F23R 3/34* (2006.01)

(52) U.S. Cl.
CPC ..... *F23R 3/286* (2013.01); *F05D 2250/25* (2013.01); *F23R 3/283* (2013.01); *F23R 3/343* (2013.01)

(58) Field of Classification Search
CPC ..... F23R 3/286; F23R 3/283; F23R 3/343
USPC ..... 60/740, 737
See application file for complete search history.

(56) References Cited

U.S. PATENT DOCUMENTS 4,141,213 A * 2/1979 Ross ..... F23M 5/085 431/285
4,387,559 A * 6/1983 Leto ..... F23R 3/283 60/39.463
4,835,971 A * 6/1989 Romey ..... F23D 11/107 239/416.5
5,105,621 A * 4/1992 Simmons ..... F01N 3/0256 422/183
5,146,741 A * 9/1992 Sood ..... F23R 3/28 60/39.55
5,224,333 A * 7/1993 Bretz ..... B05B 7/066 60/740
5,235,814 A * 8/1993 Leonard ..... F23R 3/283 60/738
5,636,511 A * 6/1997 Pfefferle ..... F01N 3/18 431/268

(Continued)

FOREIGN PATENT DOCUMENTS

JP 1767853 A2 3/2007
JP 2007107396 4/2007

(Continued)

*Primary Examiner* — Lorne Meade
*Assistant Examiner* — Eric Linderman
(74) *Attorney, Agent, or Firm* — Nixon & Vanderhye, P.C.

(57) ABSTRACT

A liquid fuel cartridge assembly for a gas turbine combustor comprising an elongated stem provided with a fuel injector tip at an aft end of said stem, said injector tip provided with a pilot fuel passage extending to a pilot fuel orifice; a plurality of air channels surrounding said pilot fuel passage and in communication with plural air holes; an annular main fuel passage surrounding said plurality of air channels and in communication with plural fuel exit holes; and a plurality of substantially radially oriented air supply holes in said stem upstream but proximate to a forward end of said tip in communication with said plurality of air channels.

20 Claims, 3 Drawing Sheets

(56) References Cited

U.S. PATENT DOCUMENTS 5,651,252 A * 7/1997 Ansart ..... F23R 3/32 239/427
5,657,632 A * 8/1997 Foss ..... F23D 17/002 239/416.4
6,032,457 A * 3/2000 McKinney ..... F23R 3/10 60/740
6,070,411 A * 6/2000 Iwai ..... F23D 17/00 60/737
6,076,356 A * 6/2000 Pelletier ..... F23D 11/107 60/740
6,094,904 A * 8/2000 Goodrich ..... F23C 7/002 60/740
6,098,407 A * 8/2000 Korzendorfer ..... F23C 7/002 60/737
6,101,814 A * 8/2000 Hoke ..... F23D 11/007 60/39.37
6,276,141 B1 * 8/2001 Pelletier ..... F23D 11/107 60/740
6,282,904 B1 * 9/2001 Kraft ..... F23R 3/343 60/39.091
6,289,676 B1 * 9/2001 Prociw ..... B05B 1/3489 60/740
6,321,541 B1 * 11/2001 Wrubel ..... G11C 7/222 60/740
6,363,726 B1 * 4/2002 Durbin ..... F23R 3/343 60/748
6,374,615 B1 * 4/2002 Zupanc ..... F23R 3/14 60/748
6,547,163 B1 * 4/2003 Mansour ..... B05B 1/3405 239/404
6,631,614 B2 * 10/2003 Mandai ..... F23D 17/002 60/737
6,698,207 B1 3/2004 Wiebe et al.
6,715,292 B1 * 4/2004 Hoke ..... F23D 11/107 239/404
6,813,889 B2 * 11/2004 Inoue ..... F23R 3/10 60/737
6,871,488 B2 * 3/2005 Oskooei ..... F23R 3/12 60/39.465
6,880,340 B2 * 4/2005 Saitoh ..... F23D 14/70 60/737
6,966,186 B2 * 11/2005 Bachovchin ..... A23L 1/3002 431/215
7,406,827 B2 * 8/2008 Bernero ..... F23C 7/002 239/127.1
7,540,154 B2 6/2009 Tanimura et al.
7,559,202 B2 * 7/2009 Prociw ..... F23R 3/283 60/740
7,677,472 B2 * 3/2010 Hessler ..... F23D 11/38 239/127.1
7,921,649 B2 * 4/2011 Lehtinen ..... F23R 3/28 60/740
8,015,813 B2 * 9/2011 Cazalens ..... F23R 3/286 431/258
8,015,815 B2 * 9/2011 Pelletier ..... F23R 3/14 239/132
8,079,218 B2 * 12/2011 Widener ..... F23D 14/48 60/737
8,146,365 B2 * 4/2012 Shum ..... F23D 11/108 60/740
8,166,763 B2 * 5/2012 Piper ..... F23R 3/283 60/737
8,186,164 B2 * 5/2012 Cowan ..... F23D 17/002 60/740
8,443,608 B2 * 5/2013 Williams ..... F02C 7/222 60/740
8,899,049 B2 * 12/2014 Krull ..... F23N 5/082 356/432
8,943,833 B2 * 2/2015 Tuthill ..... F23R 3/286 60/737
9,212,823 B2 * 12/2015 Boardman ..... F23R 3/286
9,217,373 B2 * 12/2015 Boardman ..... F02C 7/24
9,371,998 B2 * 6/2016 Cramb ..... F23R 3/343
9,551,490 B2 * 1/2017 DiCintio ..... F23R 3/14
2001/0012603 A1 * 8/2001 Bury ..... F23C 6/047 431/350
2002/0162333 A1 * 11/2002 Zelina ..... F23R 3/14 60/776
2004/0040310 A1 * 3/2004 Prociw ..... F23D 11/107 60/776
2005/0097889 A1 * 5/2005 Pilatis ..... F23D 11/107 60/743
2005/0223713 A1 10/2005 Ziminsky et al.
2006/0026966 A1 * 2/2006 Moraes ..... F23R 3/283 60/796
2006/0038326 A1 * 2/2006 Vecchiet ..... C21O 5/4606 266/218
2007/0003897 A1 * 1/2007 Koizumi ..... F23R 3/28 431/354
2007/0131796 A1 * 6/2007 Hessler ..... F23D 11/38 239/424
2009/0050710 A1 * 2/2009 Myers ..... F23D 11/38 239/132.5
2010/0095677 A1 * 4/2010 Dawson ..... F23D 14/76 60/752
2010/0205970 A1 * 8/2010 Hessler ..... F23R 3/343 60/734
2011/0056206 A1 * 3/2011 Wiebe ..... F23D 11/36 60/740
2012/0031098 A1 * 2/2012 Ginessin ..... F23R 3/14 60/740
2012/0048971 A1 * 3/2012 Kaleeswaran ..... F23R 3/28 239/602
2012/0125008 A1 * 5/2012 Prociw ..... F23R 3/346 60/776
2012/0308948 A1 * 12/2012 Melton ..... F23R 3/283 431/352
2014/0190168 A1 * 7/2014 Shershnyov ..... F23R 3/283 60/737
2014/0238026 A1 * 8/2014 Boardman ..... F02C 7/24 60/742
2015/0047361 A1 * 2/2015 Williams ..... F23R 3/343 60/746
2015/0285502 A1 * 10/2015 DiCintio ..... F23R 3/283 60/737
2015/0285504 A1 * 10/2015 Melton ..... B33Y 10/00 60/737
2016/0223201 A1 * 8/2016 Zink ..... F23R 3/28
2017/0248318 A1 * 8/2017 Kulkarni ..... F02C 7/222
2017/0363294 A1 * 12/2017 Grooms ..... F02C 7/222

FOREIGN PATENT DOCUMENTS

JP 2010203762 9/2010
JP 2010256001 11/2010
JP 2011074802 4/2011
JP 2012122715 6/2012

* cited by examiner

ANTI-COKING LIQUID FUEL INJECTOR ASSEMBLY FOR A COMBUSTOR

This application is a continuation of and claims priority to International Application No. PCT/RU2012/000992, filed Nov. 21, 2012, the entire contents of which is hereby incorporated by reference.

BACKGROUND OF THE INVENTION

This invention relates to gas turbine combustors and particularly to a liquid fuel cartridge designed to prevent formation of internal coke deposits about the fuel nozzle tip.

The formation of coke deposits at the tip of a fuel injector nozzle can interfere with the desired fuel/air mixture delivered to the combustion chamber throughout the various stages of combustion, and thus negatively impact on the reduction of oxides of nitrogen (NOx) required by exhaust emissions regulations.

One attempt to solve the coke formation problem is described in U.S. Pat. No. 6,715,292. A coke-resistant fuel injector for a low-emission combustor is formed with a pressure-atomizing core nozzle and an airblast secondary injector. The airblast portion includes inner and outer air passages for injecting co-annular, co-swirling streams into the combustor can. An air distribution baffle extends radially across the inner air passage to divide the inner airstream into a substream and a plurality of air jets. The presence of the air baffle and co-swirling inner and outer air streams is said to promote superior fuel-air mixing which promotes clean burning and resists coke formation.

BRIEF DESCRIPTION OF THE INVENTION

The present invention provides a liquid fuel cartridge (LFC) that utilizes an internal heat shield and purge air to prevent internal coking formation and overheating of the LFC tip.

In a first exemplary but nonlimiting embodiment, there is provided a liquid fuel cartridge assembly for a gas turbine combustor comprising an elongated stem provided with a fuel injector tip at an aft end of said stem, said injector tip provided with a pilot fuel passage extending to a pilot fuel orifice; a plurality of air channels surrounding said pilot fuel passage and in communication with plural air exit openings; an annular main fuel passage surrounding said plurality of air channels and in communication with plural fuel exit holes; and a plurality of substantially radially oriented air supply holes in said stem upstream but proximate to a forward end of said tip in communication with said plurality of air channels.

In another aspect, the invention provides a liquid fuel cartridge assembly for a combustor of a gas turbine comprising an elongated, hollow stem provided with a fuel injector tip at an aft end of said stem, said injector tip provided with a pilot fuel passage centered within said tip along a longitudinal axis of said tip and extending to a pilot fuel orifice; a plurality of air channels surrounding said pilot fuel passage and in communication with plural air exit openings within said fuel injector tip; an annular main fuel passage surrounding said plurality of air channels and in communication with plural fuel exit openings radially outward of said plural air exit holes; a plurality of substantially radially oriented air supply holes in said stem upstream of said tip in communication with said plurality of air channels; and wherein said stem encloses a first pilot fuel supply pipe in fluid communication with said pilot fuel passage and a second main fuel supply pipe in fluid communication with said annular main fuel passage that are intertwined along a length portion of said hollow stem.

In still another aspect, there is provided a liquid fuel cartridge assembly for a combustor of a gas turbine comprising an elongated stem provided with a fuel injector tip at an aft end of said stem, said stem enclosing main fuel and pilot fuel supply pipes, said injector tip provided with a pilot fuel passage centered within said tip along a longitudinal axis of said tip; a plurality of air channels surrounding said pilot fuel passage; an annular main fuel passage surrounding said plurality of purge/cooling air channels; and a plurality of substantially radially oriented air supply holes in said stem upstream and adjacent said fuel injector tip in communication with said plurality of air channels; wherein said injector tip is comprised of an outer sleeve, a concentrically-arranged inner sleeve and a concentrically-arranged center core; said pilot fuel passage and said plurality of air channels formed in said center core; and said annular main fuel passage formed in a radial space between said first-inner sleeve and said center core.

DETAILED DESCRIPTION OF THE INVENTION

Figure 1:
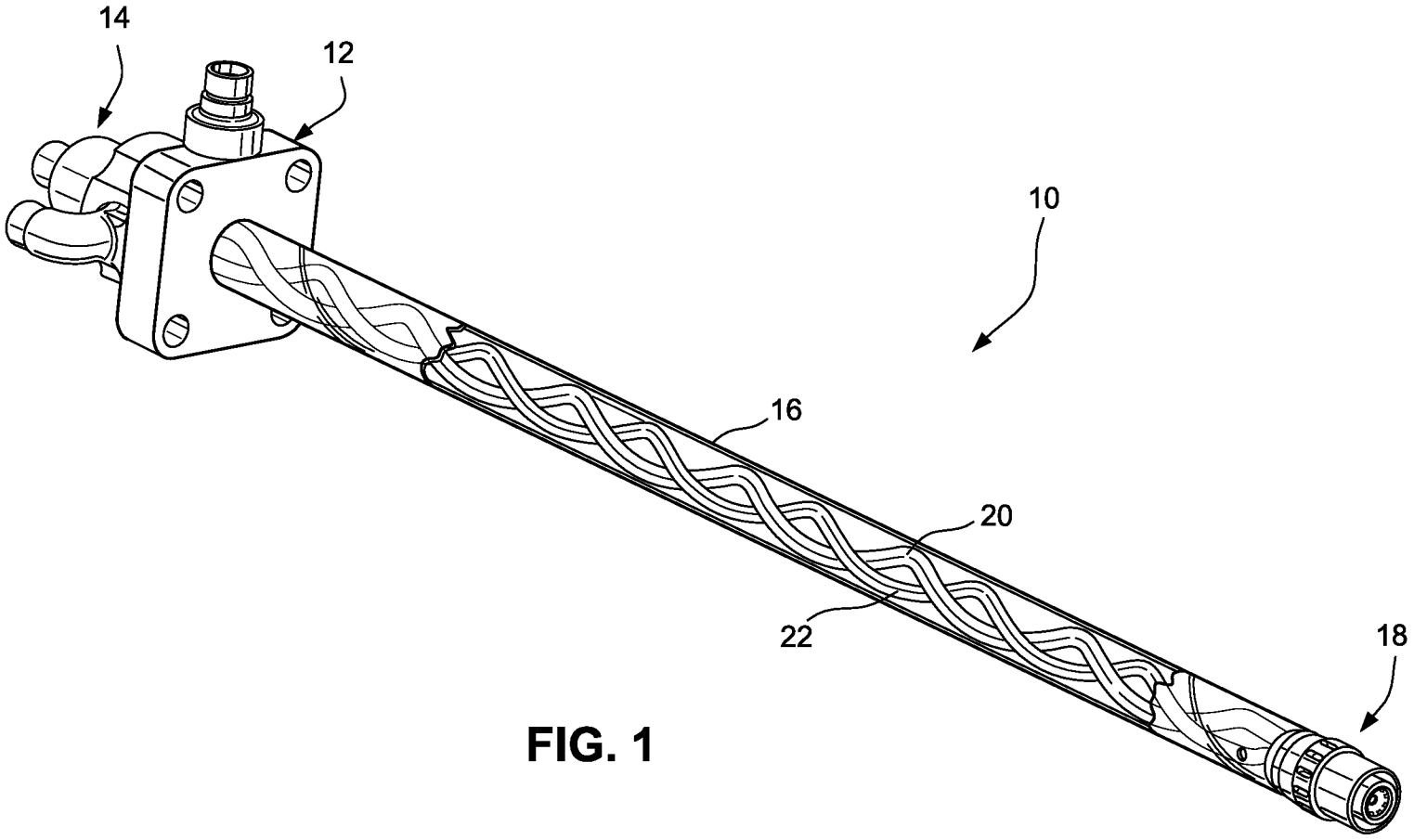
FIG. 1 is a perspective view of a liquid fuel cartridge in accordance with an exemplary but nonlimiting embodiment of the invention.

FIG. 1 illustrates a liquid fuel cartridge or injector 10 for use in gas turbine engines. The cartridge 10 is provided at a forward end with conventional mounting hardware 12 for securing the cartridge to the forward end or cap assembly (not shown) of a combustor, along with conventional fuel supply fixtures 14. A hollow stem or tube 16 extends from the mounting hardware 12 to an aft end fitted with an injector tip 18.

Liquid fuel is supplied to the tip 18 by means of intertwined conduits or helix pipes 20, 22 (see also FIG. 2) connected to the fixtures 14. Stem or tube 16 is shown as translucent merely to make visible the pipes 20, 22. Pipe 20 supplies the main fuel to the tip 18, while pipe 22 supplies pilot fuel to the tip. The pipes 20, 22 may be made from any stainless steel or other materials, having required manufacturability and mechanical properties. The intertwined arrangement of pipes 20, 22 allows for differential thermal expansion without having to design the attachment hardware and/or nozzle tip to accommodate differential expansion of the pipes.

Figure 2:
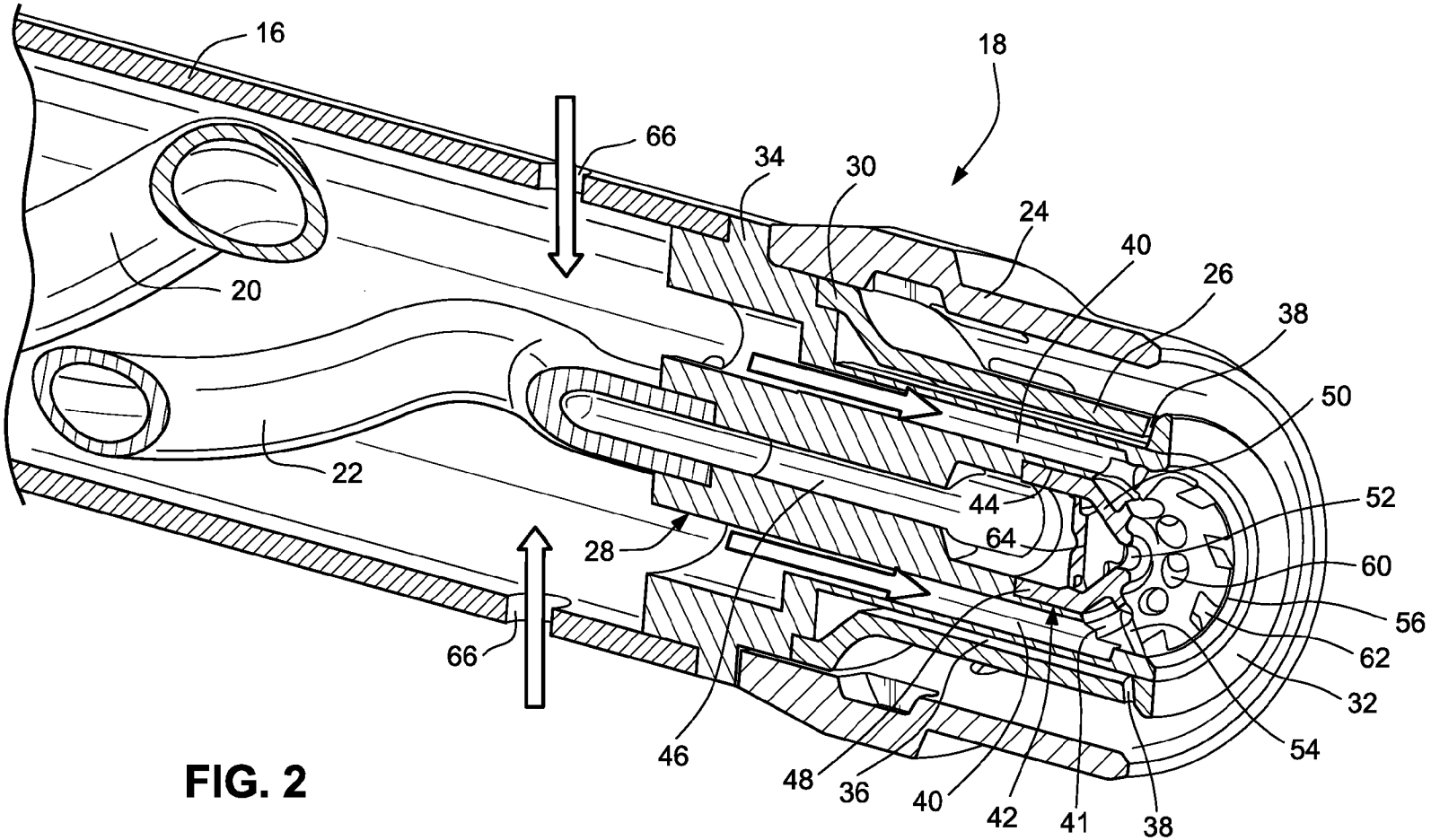
FIG. 2 is a partial perspective view of the tip portion of the liquid fuel cartridge shown in FIG. 1, sectioned to show the internal air cooling channels.

As best seen in FIG. 2, the injector tip 18 is comprised of an outer, substantially-cylindrical sleeve 24, a concentrically-arranged inner sleeve 26 and a concentrically-arranged center core 28. The first inner sleeve 26 is joined to the outer sleeve 24 at a forward, outwardly flared end 30, and to the center core 28 at an aft flanged end 32. The center core 28 is formed with a forward radial flange 34 sandwiched between the forward end of the outer sleeve 24 and the aft edge of the stem or tube 16. The securements mentioned above may be implemented in any suitable known manner, such as by welding, brazing, etc.

The radial space between the inner sleeve 26 and the center core 28 forms an annular main fuel channel 36, and the aft tip of the inner sleeve 26 is formed with slanted fuel exit orifices 38 arranged about the flanged end 32. The center core 28 is formed with a circumferentially arranged plurality of axially-extending cooling channels 40 in the radially outer region of the center core that open into an annular space 41 formed by adjacent-tapered portions 50, 54 (described below) of a nozzle insert 42. The nozzle insert 42 is received in a counterbore 44 formed in the center of the core 28. The counterbore 44 extends in an aft direction from, and is contiguous with, the bore 46 which forms the pilot fuel passage. The nozzle insert 42 includes an axially-extending cylindrical section 48 received in the counterbore 44 and an inwardly-tapered portion 50 leading to a single, centered pilot fuel exit orifice 52. The nozzle insert then extends outwardly via tapered portion 54 to an edge 56. The outwardly-tapered portion 54 includes annular rows or arrays of openings in the form of holes and optional slots 60, 62, respectively described in further detail below. A swirler element 64 is located within the nozzle insert, upstream of the exit orifice 52, where the cylindrical section 48 joins the inwardly tapered portion 50. The swirler element swirls the pilot fuel prior to its exit via the orifice 52, thus promoting better mixing with air downstream of the nozzle tip.

FIG. 2 is cut away to especially illustrate the cooling/purge air flow path through the nozzle tip 18. Specifically, cooling/purge air is supplied to the stem or tube 16 by means of a circumferential array of holes 66 located close to the forward end of the tip 18. The cooling/purge air flows through the circumferentially arranged plurality of axially-extending cooling channels 40 formed in the radially outer region of the center core 28 and into the annular space 41. The air exits through the annular rows of holes and optional slots 60, 62 in the nozzle insert 42. The rows of holes and optional slots 60, 62, respectively, may be formed of different shape (e.g., round, oval, square, oblong, etc.), swirl angles and inclination angles. In addition, the holes and optional slots in the respective rows may be angled or slanted in the same direction, or alternatively, in opposite directions to provide counter-swirling streams to effect better mixing with the fuel exiting the pilot fuel exit orifice 52. It will be understood that the row of holes 60 could be used without peripheral slots 62 and, conversely, the peripheral slots 62 could be used without the holes 60. In addition, more than one row of holes 60 could be provided, with or without the peripheral slots 62.

Figure 3:
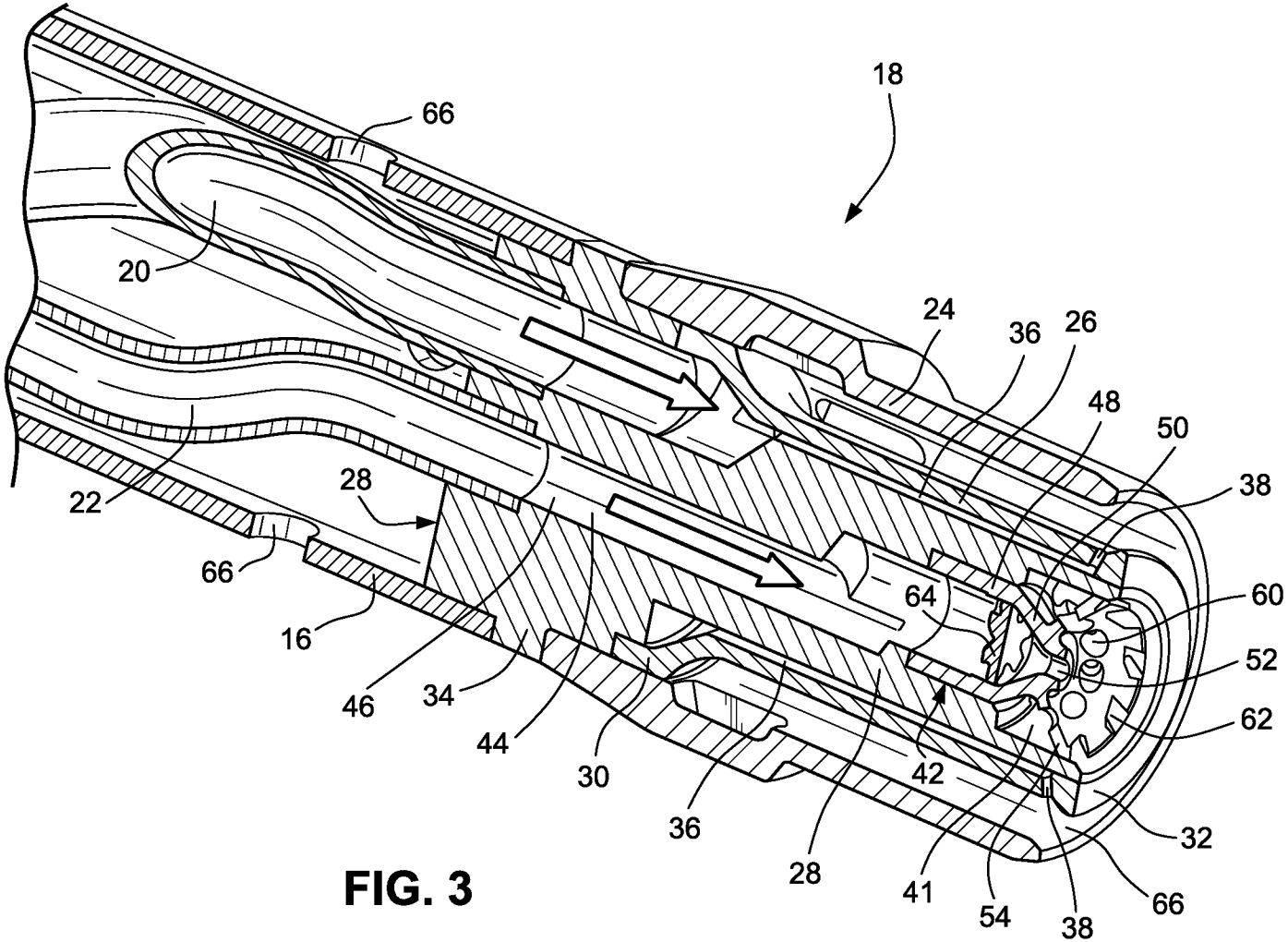
FIG. 3 is a partial perspective view of the tip portion of the liquid fuel cartridge shown in FIG. 1, sectioned to show the internal fuel supply channels.

FIG. 3 is cut away to more clearly illustrate the liquid fuel flow path through the nozzle tip 18. The pilot fuel helix pipe 22 is received in the center core 28, in communication with the bore 44 such that pilot fuel flows through the center core 28 and exits the pilot fuel nozzle orifice 52. Before exiting the orifice 52, the pilot fuel flows through the swirler 64. The main fuel helix pipe 20 is connected to the forward end of the injector tip 18, and supplies main fuel to the annular channel 36. The main fuel exits the holes 38, into a passive air space 66 between the outer sleeve 24 and the inner sleeve 26.

From the above construction, it will be appreciated that the main fuel channel 36 is insulated on opposite radial sides by purge/cooling air flowing through the channels 40 (radially inside), and passive air in the radial space between the outer sleeve 24 and the inner sleeve 26 (radially outside). The outer sleeve 24 also serves as a heat shield for the liquid fuel. The purge/cooling air entry ports 66 are located close to the tip 18 and thus provide cooler purge air than if supplied axially through the stem 16. The purge air flowing through the channels 40 also prevents overheating of the pilot fuel flowing through the center bore 46. The annular space 41 formed by the inwardly-tapered portion 50 and outwardly-tapered portion 54 of nozzle insert 42 enables the purge air to exit the annular arrays of holes and optional slots 60, 62 in a swirling and/or counter-swirling manner to thereby prevent or at least minimize coke formation at the tip of the nozzle insert 42. The purge air discharge about the pilot fuel orifice exit 52 also provides for quasi-premix purged gas combustion with reduced NOx emissions.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A liquid fuel cartridge assembly for a gas turbine combustor comprising:

an elongated stem having an aft end;

a fuel injector tip mounted to the aft end of the elongated stem and extending axially beyond the aft end, wherein the fuel injector tip includes a pilot fuel passage extending to a pilot fuel orifice and said fuel injector tip extending axially beyond the aft end of the elongated stem;

air channels in the fuel injector tip and arranged around the pilot fuel passage and in communication with air exit openings;

an annular main fuel passage arranged around the air channels and in communication with fuel exit holes, wherein the pilot fuel passage and the annular main fuel passage forms a double helix that extends axially through the elongated stem; and radially oriented air supply holes in the elongated stem upstream and proximate to a forward end of the fuel injector tip in communication with the air channel.

2. The liquid fuel cartridge assembly of claim 1 wherein a nozzle insert is located within said fuel injector tip and is provided with said pilot fuel orifice.

3. The liquid fuel cartridge assembly of claim 2 wherein said nozzle insert includes the air exit openings.

4. The liquid fuel cartridge assembly of claim 3 wherein said nozzle insert includes a first inwardly-tapered portion extending to said pilot fuel orifice, and a second outwardly-tapered portion downstream of said pilot fuel orifice, wherein said air exit openings are located in said second outwardly-tapered portion.

5. The liquid fuel cartridge assembly of claim 1 wherein said fuel injector tip is comprised of an outer sleeve, a concentrically-arranged inner sleeve and a concentrically-arranged center core; and said pilot fuel passage and said air channels are formed in said concentrically-arranged center core;

wherein said annular main fuel passage is formed in a radial space between said concentrically-arranged inner sleeve and said concentrically-arranged center core.

6. The liquid fuel cartridge assembly of claim 5 wherein said concentrically-arranged inner sleeve is formed at an aft end with an annular flanged end, and wherein circumferentially-spaced main fuel orifices are in communication with said annular main fuel passage and are located on an upstream side of said annular flanged end.

7. The liquid fuel cartridge assembly of claim 3 wherein said air exit openings comprise at least one annular row of holes or an annular row of slots slanted in a circumferential direction.

8. The liquid fuel cartridge assembly of claim 4 wherein a swirler is located within said nozzle insert, upstream and adjacent of the first inwardly-tapered portion.

9. The liquid fuel cartridge assembly of claim 7 wherein the air exit openings comprise a radially inner row of holes and a radially outer row of slots, and further wherein the holes in said at least one annular row of holes and the slots in said radially outer row of slots are slanted in different directions.

10. A liquid fuel cartridge assembly for a combustor of a gas turbine comprising:

an elongated, hollow stem including an aft end;

a fuel injector tip mounted to the aft end of said elongated, hollow stem and extending axially beyond the elongated, hollow stem, wherein the fuel injector tip extends axially beyond the aft end of the elongated, hollow stem and the fuel injector tip is provided with a pilot fuel passage centered within said fuel injector tip along a longitudinal axis of said fuel injector tip and extending to a pilot fuel orifice;

air channels in the fuel injector tip, arranged around the pilot fuel passage and in communication with air exit openings at an aft end of the fuel injector tip;

an annular main fuel passage in the fuel injector tip, arranged around the air channels and in communication with fuel exit holes proximate the aft end of the fuel injector tip and radially outward of the air exit openings;

radially oriented air supply holes in the elongated, hollow stem upstream of the fuel injector tip in communication with the air channels; and wherein said elongated, hollow stem encloses a first pilot fuel supply pipe in fluid communication with said pilot fuel passage and a second main fuel supply pipe in fluid communication with said annular main fuel passage, wherein the first pilot fuel supply pipe and the second main fuel supply pipe forms a double helix that extends axially through said elongated, hollow stem.

11. The liquid fuel cartridge assembly of claim 10 wherein a nozzle insert is located within said fuel injector tip and is provided with a said pilot fuel orifice, and said air exit holes.

12. The liquid fuel cartridge assembly of claim 11 wherein said nozzle insert comprises a first inwardly-tapered portion extending to said pilot fuel orifice and a second outwardly-tapered portion downstream of said pilot fuel orifice, wherein said air exit openings are in said second outwardly-tapered portion.

13. The liquid fuel cartridge assembly of claim 12 wherein the air exit openings comprise at least one radially inner, annular row of holes and a radially outer, annular row of slots, and further wherein holes in said at least one row of holes and/or slots in said annular row of slots are slanted in a circumferential direction.

14. The liquid fuel cartridge assembly of claim 12 wherein an annular air chamber is formed between said first inwardly-tapered portion and said second outwardly-slanted portion, externally of said nozzle insert.

15. A liquid fuel cartridge assembly for a combustor of a gas turbine comprising:

an elongated stem including an aft end, wherein the elongated stem encloses a main fuel pipe and a pilot fuel pipe;

a fuel injector tip at the aft end of said elongated stem and extending axially beyond the aft end, wherein the fuel injector tip includes a pilot fuel passage centered within said fuel injector tip along a longitudinal axis of said fuel injector tip;

air channels in the fuel injector tip and arranged around the pilot fuel passage;

an annular main fuel passage in the fuel injector tip and arranged around the air channels; and radially oriented air supply holes in the elongated stem upstream, adjacent the fuel injector tip and in communication with the air channels;

wherein the fuel injector tip includes an outer sleeve, a concentrically-arranged inner sleeve and a concentrically-arranged center core;

said pilot fuel passage and said air channels are in said center core; and said annular main fuel passage formed in a radial space between the concentrically-arranged inner sleeve and the concentrically-arranged center core, wherein the pilot fuel passage and the annular main fuel passage forms a double helix that extends axially through the elongated stem.

16. The liquid fuel cartridge assembly of claim 15 wherein a nozzle insert is in the fuel injector tip, said nozzle insert is provided with said pilot fuel orifice and air exit openings in communication with said air channels, and a swirler upstream of said pilot fuel orifice.

17. The liquid fuel cartridge assembly of claim 16 wherein said nozzle insert includes a first inwardly-tapered portion extending to said pilot fuel orifice, and a second outwardly-tapered portion downstream of said pilot fuel orifice, wherein said air exit openings are in said second outwardly-tapered portion.

18. The liquid fuel cartridge assembly of claim 17 wherein said air exit openings comprise at least one radially inner annular row of holes and a radially outer annular row of slots, and further wherein the holes in said at least one radially inner annular row of holes, or the slots in said radially outer row of slots, are slanted in a circumferential direction.

19. The liquid fuel cartridge assembly of claim 17 wherein said air exit openings comprise at least one radially inner annular row of holes and a radially outer row of slots, and further wherein the holes in said at least one annular row of holes, and the slots in said radially outer row of slots, are slanted in different directions.

20. The liquid fuel cartridge assembly of claim 15 wherein said concentrically-arranged inner sleeve is includes an annular flanged aft end, and wherein circumferentially-spaced main fuel orifices are in communication with said annular main fuel passage and are on an upstream side of said annular flanged aft end.

* * * * *